US009085429B1

(12) United States Patent
Cheng

(10) Patent No.: US 9,085,429 B1
(45) Date of Patent: Jul. 21, 2015

(54) INTERMITTENT DRIVE FEEDING MECHANISM

(71) Applicant: Avision Inc., Hsinchu (TW)

(72) Inventor: Sung-Po Cheng, Hsinchu (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 14/325,503

(22) Filed: Jul. 8, 2014

(30) Foreign Application Priority Data

Apr. 8, 2014 (TW) ..... 103112897 A

(51) Int. Cl.
*B65H 3/06* (2006.01)
*B65H 5/06* (2006.01)

(52) U.S. Cl.
CPC ..... *B65H 3/0669* (2013.01); *B65H 5/06* (2013.01)

(58) Field of Classification Search
CPC ..... B65H 3/0669; B65H 3/0684; B65H 1/04; B65H 3/0615; B65H 3/06; B65H 3/52; B65H 3/5207; B65H 3/5215; B65H 3/523; B65H 3/5238; B65H 2403/72; B65H 2403/722; F16H 3/34; F16H 3/363; F16H 21/14; F16H 35/02; F16H 3/02; F16H 3/093; F16H 61/0293; F16H 2710/26
USPC ..... 271/114, 117, 118, 124, 121, 122, 116; 74/352, 69, 325, 337
See application file for complete search history.

(56) References Cited

U.S. PATENT DOCUMENTS

| | | | | |
|---|---|---|---|---|
| 7,152,858 | B2 * | 12/2006 | Lin | 271/117 |
| 7,275,741 | B2 * | 10/2007 | Worley et al. | 271/117 |
| 7,431,284 | B2 * | 10/2008 | Gaarder et al. | 271/114 |
| 7,472,903 | B2 * | 1/2009 | Nakakita et al. | 271/114 |
| 7,484,723 | B2 * | 2/2009 | Kuo et al. | 271/10.09 |

* cited by examiner

*Primary Examiner* — Thomas Morrison

(57) ABSTRACT

An intermittent feeding mechanism applied in the automatic document feeder (ADF) of a business machine. By design of integrating components, manufacturing costs and assembly work can be reduced efficiently, thus associated costs can be further reduced. Besides, the built-in design of the present disclosure can reduce the installation space and facilitate the miniaturization of a business machine.

6 Claims, 5 Drawing Sheets

INTERMITTENT DRIVE FEEDING MECHANISM

CROSS-REFERENCE TO RELATED APPLICATION

This application claims the benefit of Taiwan Patent Application No. 103112897, filed on Apr. 8, 2014, in the Taiwan Intellectual Property Office, the disclosure of which is incorporated herein in its entirety by reference.

BACKGROUND OF THE INVENTION

1. Field of the Invention

The present disclosure relates to an intermittent feeding mechanism, in particular, to an intermittent feeding mechanism applied in an automatic document feeder of the business machine, and the important components of the intermittent feeding mechanism are integrated to decrease manufacturing cost and assembly working hour efficiently, so as to save associated cost.

2. Description of the Related Art

As science and technology improve, a scanner capable of digitizing the physical document becomes a necessary apparatus in office. The scanner having an automatic document feeder can feed multiple sheets one by one automatically so that the scanning time can be shortened efficiently. However, when the feeding interval between a first sheet and a second sheet is not large enough to be recognized by the scanner, the subsequent processes are easy to be affected. For example, the two page images of two original sheets may be misjudged as one page image.

To solve this problem, the prior art discloses using of an electronic clutch to control the speed difference between the rollers for generating feeding intervals between sheets. However, the electronic clutch has large volume and high price, so it is not easy for miniaturization and decreasing the total cost of the business machine. Moreover, other prior art discloses using of an intermittent mechanism to separate sheets. However, the structure of the intermittent mechanism is too complex with too many components, so its assembly is minute and complicated and requires more assembly working hour, resulting in the increasing of the cost.

SUMMARY OF THE INVENTION

To solve the problem in prior art, one of objectives of the present disclosure is to provide an intermittent feeding mechanism in which the important components are integrated to solve the problems of assembly margin or wearing of component due to many components used in traditional intermittent roller.

Another objective of the present disclosure is to provide an intermittent feeding mechanism in which the important components are integrated to reduce manufacturing cost and assembly working hour efficiently to save associated cost.

Another objective of the present disclosure is to provide an intermittent feeding mechanism which applies the built-in design to make exterior appearance clean, so as to reduce the installation space to facilitate miniaturization of device.

An exemplary embodiment of the present disclosure provides an intermittent feeding mechanism which is mounted in an automatic document feeder. The intermittent feeding mechanism comprises a driving component, a transmission component, a roller axle and a separating roller. The transmission component is connected to the driving component. The roller axle is installed on the structure of the automatic document feeder, and one side of the roller axle is connected to the driving component via the transmission component. The separating roller comprises a bush, a friction sleeve, a one way clutch and an intermittent sleeve. The bush is inserted into the roller axle, and the friction sleeve is mounted at an outer side of the bush and contacts a plurality of sheets. The one way clutch is connected to the roller axle to act simultaneously, and is mounted inside the intermittent sleeve. The intermittent sleeve is connected to the bush to drive the bush to rotate intermittently, so as to deliver the plurality of sheets.

Preferably, the intermittent feeding mechanism further comprises a friction pad which is disposed above the separating roller opposite to form a feeding channel to deliver or separate the plurality of sheets.

Preferably, the one way clutch and the intermittent sleeve are built-in the bush.

Preferably, the one way clutch and the intermittent sleeve are integrated.

Preferably, the transmission component comprises a set of gears or a set of timing belt.

Preferably, material of the friction sleeve comprises metal material, rubber material or polymer material.

Preferably, an inner surface of the bush is provided with a rib.

Preferably, the intermittent sleeve is provided with a prominence to fit a clearance of the rib, so as to drive the bush to rotate intermittently.

Preferably, another side of the roller axle further comprises a bearing, which is mounted on the structure of the automatic document feeder, for maintaining the intermittent feeding mechanism operating smoothly.

The main objective of the present disclosure is to provide an intermittent feeding mechanism which has the following advantages.

First, the stock cost of the intermittent feeding mechanism can be reduced. The components of the intermittent feeding mechanism of the present disclosure are integrated to reduce the amount of the associated components, so as to decrease manufacturing cost and stock cost of these components.

Second, the assembly work can be shortened. As the number of components is reduced, the assembly working procedure can be simplified to shorten working hours.

Thirdly, the generation of noise can be reduced. The components of the intermittent feeding mechanism are integrated to reduce number of the components, so the probability of generating noise while the components are operated can be decreased.

Fourthly, the wearing of the component can be reduced. The wearing between the components with different materials during operation can be prevented, so as to extend ages of the components.

Fifthly, the structure is designed built-in. The important components are assembled inside the separating roller, so that the installation space can be decreased to facilitate miniaturization of the device.

The above and other features and advantages of the example embodiments will become more apparent by describing in detail preferred embodiments thereof with reference to the attached drawings.

BRIEF DESCRIPTION OF THE DRAWINGS

The detailed structure, operating principle and effects of the present invention will now be described in more details hereinafter with reference to the accompanying drawings that show various embodiments of the invention as follows.

DETAILED DESCRIPTION OF THE PREFERRED EMBODIMENTS

Figure 1:
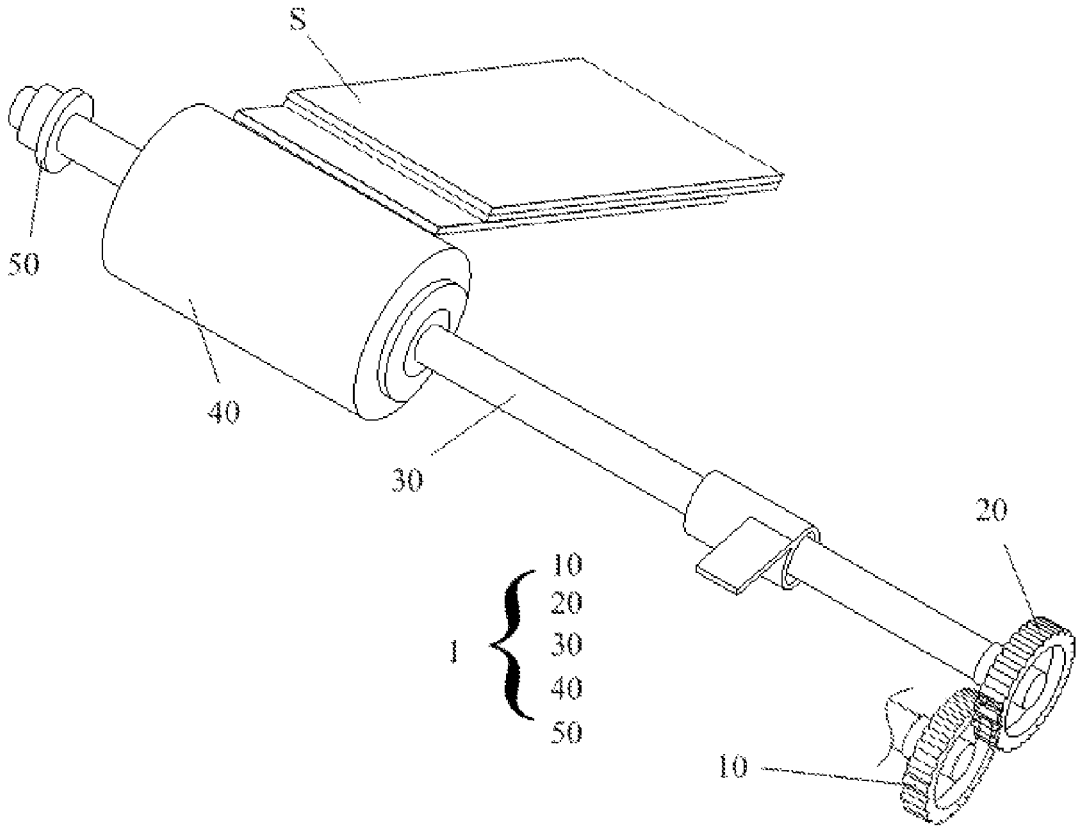
FIG. 1 is an assembly view of an intermittent feeding mechanism according to the present disclosure.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

Figure 2:
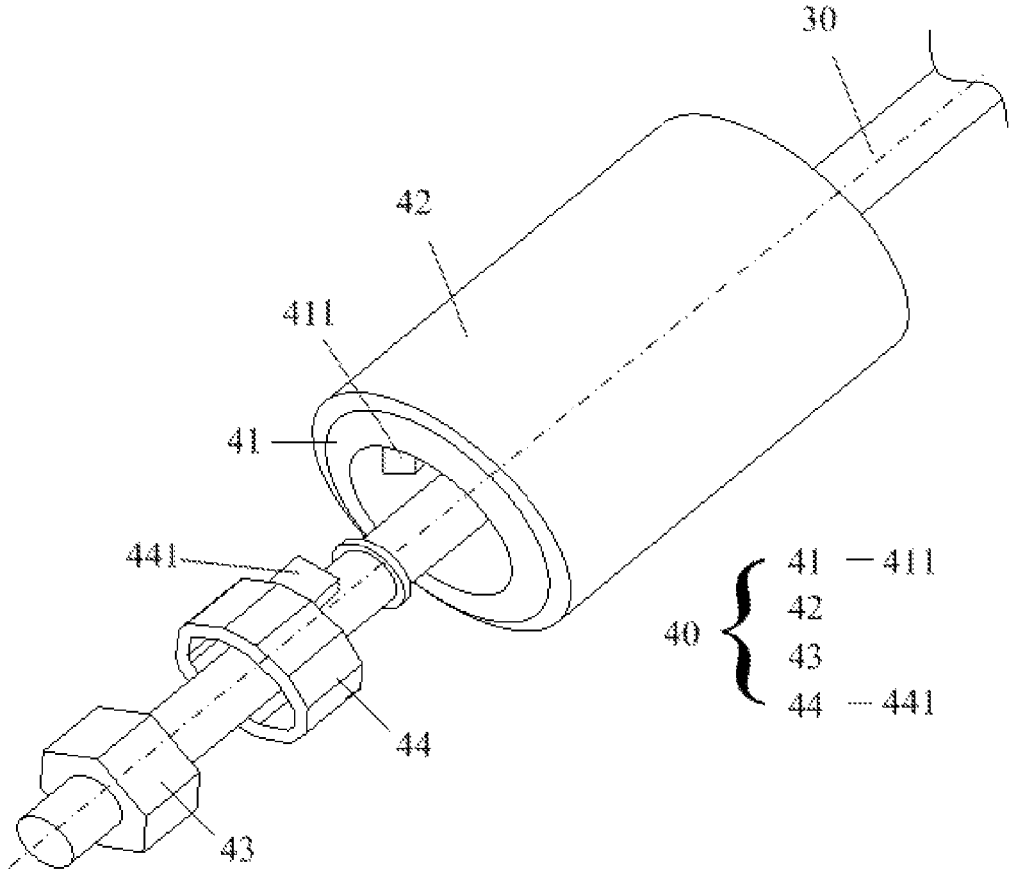
FIG. 2 is an exploded perspective view of a separating roller of the intermittent feeding mechanism according to the present disclosure.
Figure 3:
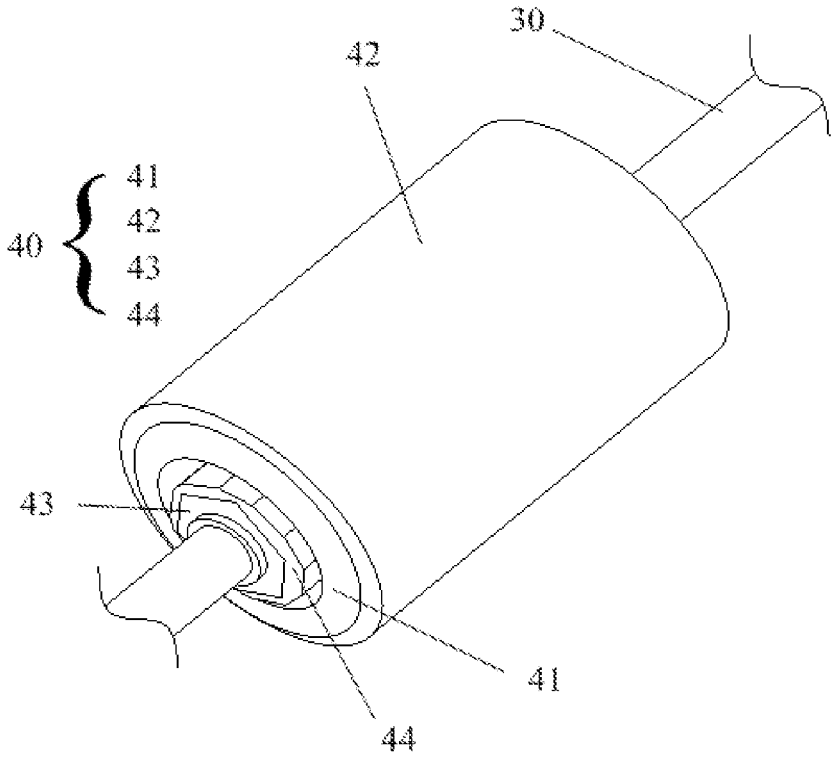
FIG. 3 is an assembly view of the separating roller of the intermittent feeding mechanism according to the present disclosure.

Please refer to FIG. 1 to FIG. 3. The intermittent feeding mechanism 1 according to the present disclosure is mounted in an automatic document feeder of a business machine. The intermittent feeding mechanism 1 comprises a driving component 10, a transmission component 20, a roller axle 30 and a separating roller 40. The driving component 10 is a power driving mechanism to provide a driving power. The transmission component 20 is connected to the driving component 10 to drive the roller axle 30 to rotate. The transmission component 20 can be a set of gears or a set of timing belt, to provide stable rotating speed. The roller axle 30 is installed on the structure of the automatic document feeder, and one side of the roller axle 30 is connected to the driving component 10 via the transmission component 20.

The separating roller 40 comprises a bush 41, a friction sleeve 42, a one way clutch 43 and an intermittent sleeve 44. The bush 41 is inserted into the roller axle 30. The friction sleeve 42 is mounted at an outer side of the bush 41 and contacts a plurality of sheets S. The one way clutch 43 is connected to the roller axle 30 and acts with the roller axle 30 simultaneously. The one way clutch 43 is mounted inside the intermittent sleeve 44. The intermittent sleeve 44 is connected to the bush 41 to drive intermittent rotation of the bush 41, so as to deliver the plurality of sheets S.

Another side of the roller axle 30 further comprises a bearing 50. The bearing 50 is mounted on the structure of the automatic document feeder to maintain smooth operation of the intermittent feeding mechanism 1. The material of the friction sleeve 42 comprises metal material, rubber material or polymer material. The sheet S comprises paper, card or slide, but the present disclosure is not limited.

In implementation, the one way clutch 43 is an assembly just operating unidirectionally. While rotating at reversing direction, the internal component and the external component of the one way clutch 43 are separated to enable free rotation of the internal component and non-rotation of the external component. The one way clutch 43 and the intermittent sleeve 44 are fitted with each other, or are integrated. The one way clutch 43 and the intermittent sleeve 44 can be built-in inside the bush 41, so as to save the installation space to facilitate miniaturization of the business machine.

Figure 4:
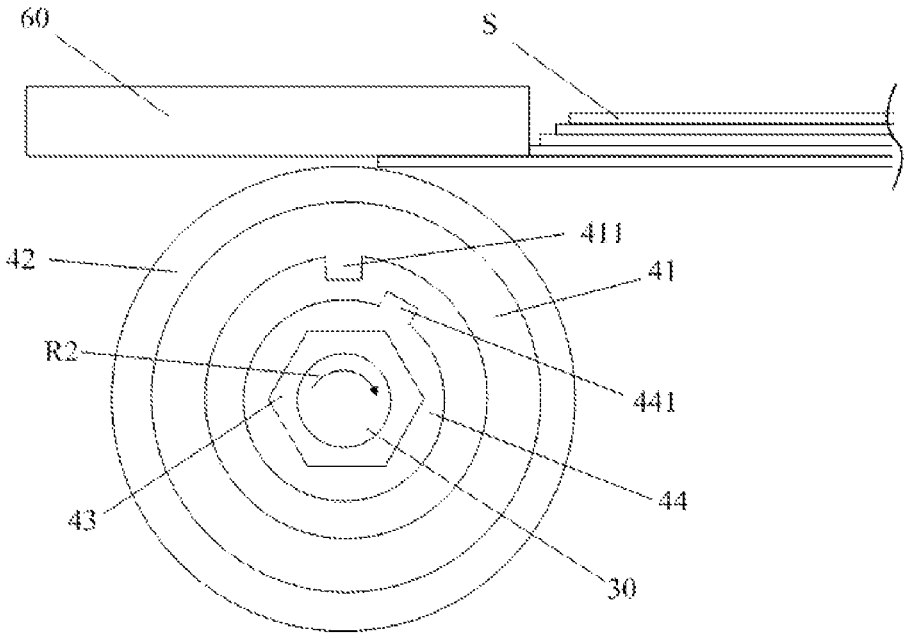
FIG. 4 is a first operational schematic view of the separating roller of the intermittent feeding mechanism according to the present disclosure.

Please refer to FIG. 4, which is a first operational schematic view of a separating roller in accordance with the present disclosure. The intermittent feeding mechanism 1 further comprises a friction pad 60. The friction pad 60 is disposed above the separating roller 40 opposite to form a feeding channel to deliver the plurality of sheets S. The inner surface of the bush 41 is provided with a rib 411. The rib 411 is embedded on the bush 41 or directly formed by extending from the inner surface of the bush 41. The intermittent sleeve 44 can be provided with a prominence 441 which is clearance fit with the rib 411 to drive the bush 41 to operate intermittently.

For example, when the roller axle 30 rotates along the second direction R2, the one way clutch 43 can just rotate unidirectionally, so the roller axle 30 just drives the internal component of the one way clutch 43 to rotate but not drive the intermittent sleeve 44 to rotate simultaneously. Therefore, the sheet S stops in front of the feeding channel due to loss of the driving power.

Figure 5:
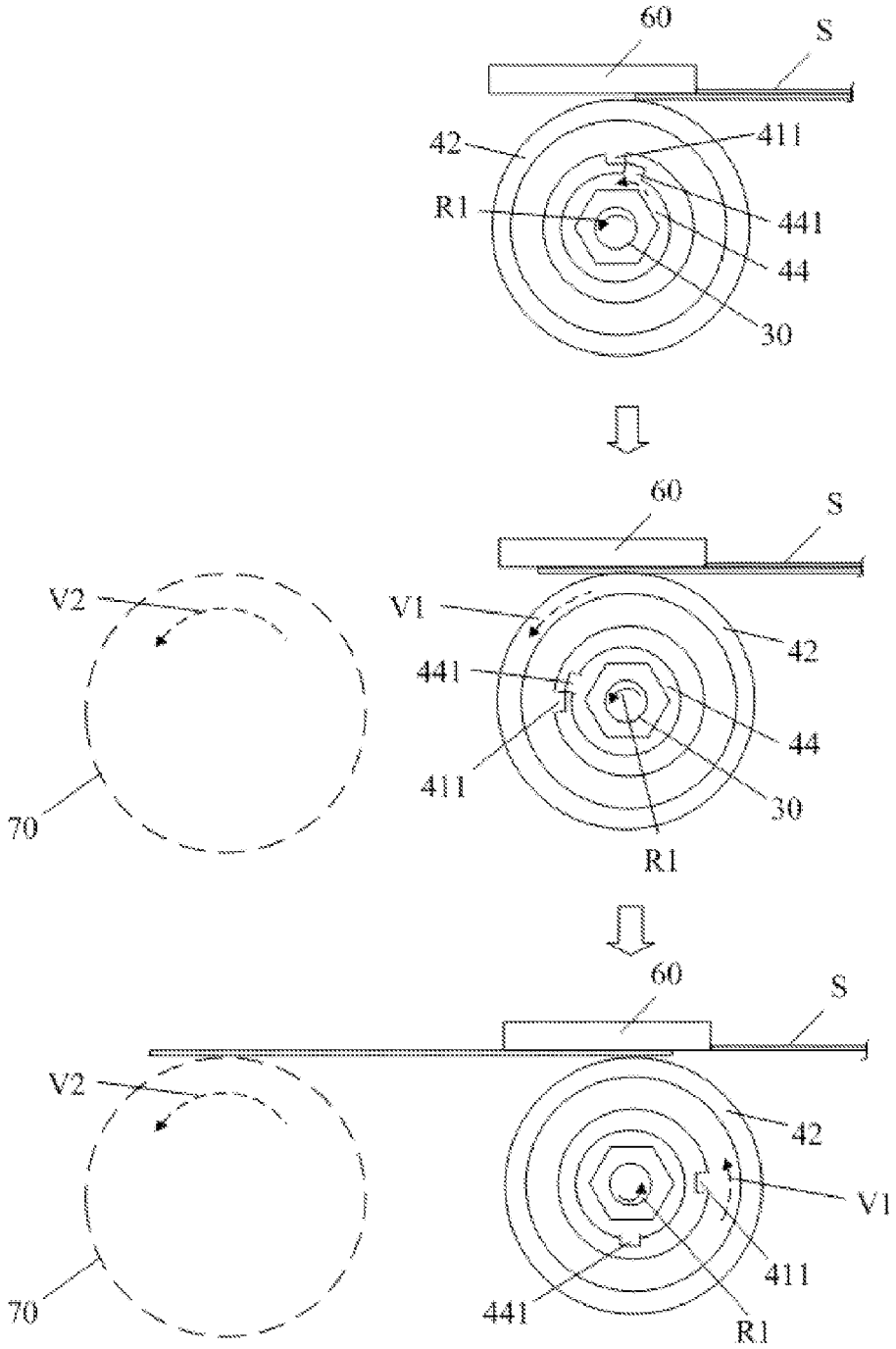
FIG. 5 is a second operational schematic view of the separating roller of the intermittent feeding mechanism according to the present disclosure.

Please refer to FIG. 5, which is a second operational schematic view of the separating roller in accordance with the present disclosure. When the roller axle 30 rotates along the first direction R1, the one way clutch 43 drives the intermittent sleeve 44 to rotate simultaneously. In this case, the prominence 441 of the intermittent sleeve 44 pushes the rib 411 of the bush 41 to drive the bush 41 to rotate simultaneously. Therefore, the sheet S is driven by the friction pad 60 and the friction sleeve 42 to move toward the feeding side. Moreover, the feeding side of the intermittent feeding mechanism 1 is further provided with a delivering roller 70 to assist the movement of the sheet S.

In implementation, a delivering speed V2 generated by the contact surface of the delivering roller 70 can be set as a constant, and the feeding speed V1 of the separating roller 40 varies upon the operating status, so that the sheets S can be separated according to the difference between the feeding speed V1 and the delivering speed V2.

For further illustration, when the sheet S enters the feeding channel but does not contact the delivering roller 70, the prominence 441 of the intermittent sleeve 44 touches and pushes the rib 411 of the bush 41 continuously by the separating roller 40, to drive the separating roller 40 to rotate simultaneously. The feeding speed V1 corresponds to the rotating speed of the roller axle 30.

However, when the sheet S moves toward the feeding side continuously and contacts the delivering roller 70, the sheet S moves toward the feeding side in delivering speed V2 correspondingly and the speed of the friction sleeve 42 and the bush 41 are increased simultaneously resulting from the delivering speed V2 of the delivering roller 70 which is faster than the feeding speed V1 of the roller axle 30 a little. Therefore, the rib 411 of the bush 41 can depart from effect of the prominence 441 of the intermittent sleeve 44, and the distance between the rib 411 and the prominence 441 increases gradually.

Moreover, when the sheet S is separated from the separating roller 40 completely, the friction sleeve 42 and the bush 41 stop due to loss of the driving force, causing the roller axle 30 rotating continuously to drive the prominence 441 of the intermittent sleeve 44 to contact the rib 411 of the bush 41 again for next operation. Therefore, the objective of intermittent separation can be achieved.

The present disclosure utilizes the one way clutch and design of intermittent speed difference bringing about the advantages of reduced amount of components and simple molding and function work. Compared with the prior art, the present disclosure further has the advantages in cost and assembly work.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. An intermittent feeding mechanism, mounted in an automatic document feeder, and the intermittent feeding mechanism comprising:

a driving component;

a transmission component, connected to the driving component;

a roller axle, installed on a structure of the automatic document feeder, and one side of the roller axle connected to the driving component via the transmission component;

a separating roller, comprising a bush, a friction sleeve, an one way clutch and an intermittent sleeve;

a friction pad, disposed above the separating roller to form a feeding channel to deliver a plurality of sheets; and a delivering roller, disposed on the feeding channel and next to the separating roller, and rotating in the same direction of the roller axle, wherein a delivering speed of the delivering roller is faster than a feeding speed of the roller axle, wherein the roller axle is inserted into the bush, the friction sleeve is mounted at an outer side of the bush and contacts the plurality of sheets, the one way clutch is connected to the roller axle for moving together therewith, the one way clutch is mounted inside the intermittent sleeve, and the intermittent sleeve has a clearance fit with the bush, an inner surface of the bush is provided with a rib, the intermittent sleeve is provided with a prominence to periodically engage the rib to drive the bush to rotate intermittently, so as to deliver the plurality of sheets.

2. The intermittent feeding mechanism according to claim 1, wherein the one way clutch and the intermittent sleeve are disposed inside the bush.

3. The intermittent feeding mechanism according to claim 1, wherein the one way clutch and the intermittent sleeve are integrated.

4. The intermittent feeding mechanism according to claim 1, wherein the transmission component comprises a set of gears.

5. The intermittent feeding mechanism according to claim 1, wherein the material of the friction sleeve comprises metal material, rubber material or polymer material.

6. The intermittent feeding mechanism according to claim 1, wherein another side of the roller axle further comprises a bearing, the bearing is mounted on the structure of the automatic document feeder to maintain the intermittent feeding mechanism to operate smoothly.

* * * * *